US005471765A

United States Patent [19]

Rautakorpi et al.

[11] Patent Number: 5,471,765

[45] Date of Patent: Dec. 5, 1995

[54] ARRANGEMENT IN A DRYER FOR A FIBRE WEB

[75] Inventors: Paavo Rautakorpi; Jari Ilomäki; Jukka Lehtinen, all of Tampere, Finland

[73] Assignee: Valmet-Tampella Oy, Tampere, Finland

[21] Appl. No.: 186,776

[22] Filed: Jan. 26, 1994

[30] Foreign Application Priority Data

Feb. 1, 1993 [FI] Finland ..... 930442

[51] Int. Cl.[6] ..... F26B 25/00

[52] U.S. Cl. ..... 34/242; 277/135; 162/371; 34/634

[58] Field of Search ..... 34/629, 242, 145, 34/95, 422, 69, 634; 277/135, DIG. 7; 162/371

[56] References Cited

U.S. PATENT DOCUMENTS 4,112,586 9/1978 Lehtinen ..... 34/95

4,787,641 11/1988 Rautakorpi et al. ..... 34/242

*Primary Examiner*—Denise L. Gromada

*Attorney, Agent, or Firm*—Ladas & Parry

[57] ABSTRACT

An arrangement in a dryer for a fibre web for sealing bands (5*a*, 5*b*) that move between a chamber (3) containing pressurized vapor and a chamber (1) containing pressurized water and transport a web (7) and a felt (8) between them, and also for sealing the edges of the chambers (1, 3). The arrangement comprises a closed recovery chamber (16) into which the edges of the bands (5*a*, 5*b*) extend and in which the vapor escaping from the vapor chamber (3) from between the band (5*a*) and the seals (9, 10) and the water escaping from the water chamber (1) from between the band (5*b*) and the seals (12, 13) gather, whereby the vapor and water can be discharged from the recovery chamber (16) such that they are cannot escape into surrounding air.

10 Claims, 1 Drawing Sheet

ARRANGEMENT IN A DRYER FOR A FIBRE WEB

Figure 1:
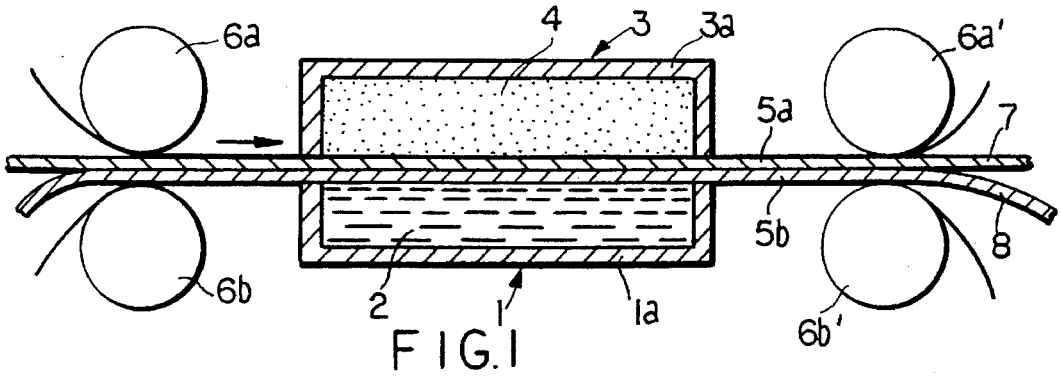

The invention concerns an arrangement in a dryer for a fibre web, the arrangement comprising two chambers that are one upon another and contain a pressurized medium which in at least one of the chambers is vapour and two impermeable bands travelling between the chambers and forming an endless loop, each band providing one wall for one chamber, the fibre web and the wire in the arrangement travelling through the dryer between the bands, and at least one sealing member being provided between the edge of the body of the lower chamber and the band next to it to effect sealing between the moving band and the body of the chamber.

This kind of arrangement is known e.g. from Finnish Patent 76,192, which discloses a solution for implementing sealing. In the FI patent, sealing is effected by two seals arranged against the moving band, a sealing liquid being supplied between the seals. Due to this, vapour cannot escape from the vapour chamber but only a sealing liquid discharges from between the band and the seal. Although the solution is functional as such, it is more advantageous with respect to the operation and use of the apparatus to create a situation where the seals are not as heavily loaded as earlier and where the temperature of the hot band next to the vapour chamber could be maintained essentially constant over its entire breadth, whereby the thermal stress to which the band is exposed decreases.

Further, arrangements like this are previously known from German Offenlegungsschrift 31,29,920.6 and European Patent Application 01,26,865, which disclose solutions relating to production of chipboard. The disadvantage of DE 31,29,920.6 is that due to the structure pressurized vapour may escape as the thickness of the web varies and thus cause noise problems as well as other problems brought about by escaping vapour. Also in the solution of EP 01,26,865 vapour easily escapes, causing noise problems as well as other problems brought about by escaping vapour.

Another solution relating to an arrangement of this kind is known from Finnish Patent 66,041, where the solution comprises a body that is rigid and heavy. In this solution a great force is produced between the seal and the band, whereby moving of the band requires great power. Further, the frictional force causes the temperature to rise high, whereby both the seal and the band are easily damaged even in a short time. Also in this publication the vapour escaping from between the seal and the band causes noise problems as well as other problems brought about by escaping vapour.

In all these known solutions the seals at the edges of the chambers seal off the pressure of the pressure chambers, whereby friction and leaks easily increase in amount and the seals are subjected to stress. Further, the condensate discharging from the vapour chamber boils under normal pressure, cooling the edges of the hot band to about 100° C., whereby a great tensile stress is generated at the edges of the band. Due to this, the edges of the band stretch or crack.

The object of the present invention is to provide a better and more functional arrangement, by which problems caused by escaping of vapour on the one hand and by wear of the seals on the other hand are avoided and the sealing and the temperature of the bands are rendered more even. It is characteristic of the arrangement according to the invention that it comprises, on the side of the chambers, recovery chambers into which the edges of the bands extend and which are isolated from the surrounding air and the chambers, the pressurized medium discharged from both chambers from between the bodies and the bands gathering in said recovery chambers and being dischargeable therefrom through outlet conduits.

The essential idea of the invention is that at the edges of the bands—on the outside thereof—is provided a separate recovery chamber isolated from the surrounding air, both the vapour escaping from the vapour chamber from between the hot band and the seals and the water escaping from the water chamber from between the cold band and the seals discharging into said recovery chamber. As the vapour flows along the surface of the band, it keeps the edge of the band hot and, correspondingly, as the water flows along the edge of the cold band, it keeps the edge cold. The noise problems caused by vapour are here also avoided since the vapour discharges into the chamber and not into air and the escaped water and vapour can be gathered and reused. Since the recovery chambers also operate under pressure, the seals are subjected to a smaller pressure load and their life is prolonged. The advantage of the invention is that the solution is fairly simple and easy to implement since no sealing water is needed between the vapour-proof seals. The noise problems brought about by escaping vapour are also avoided and the durability of the seals is improved since the seals are not exposed to the full pressure prevailing in the chambers because the side chamber is pressure-proof.

Figure 2:
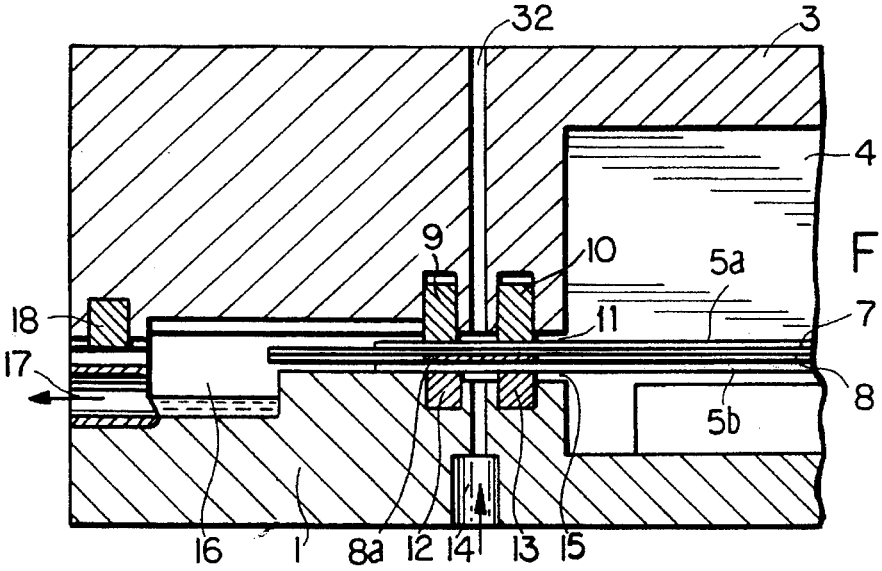
Figure 3:
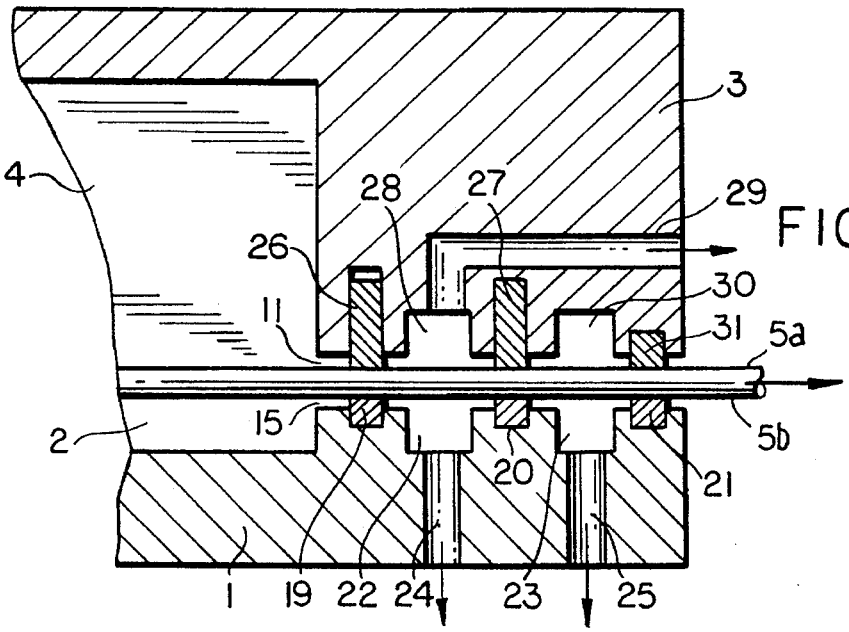

The invention will be described in greater detail with reference to the attached drawings, wherein FIG. 1 shows a schematic cross-sectional side view of the dryer of a paper machine in which the arrangement according to the invention is used, FIG. 2 shows a schematic cross-sectional view of the arrangement according to the invention seen from the travel direction of the web, and FIG. 3 shows a schematic cross-sectional view of the arrangement according to the invention seen from the transverse direction of the web.

FIG. 1 shows a schematic view of a so called Condebelt dryer, which comprises a cooling chamber 1 containing water or some other suitable liquid 2. It further comprises a vapour chamber 3 containing hot pressurized vapour 4. Between the chambers 1 and 3 run bands *5a* and *5b* in a known manner, the bands being impermeable to air, preferably made of metal and having a good heat conductivity and running around rolls *6a*, *6b* and *6a'*, *6b'* respectively, each band forming an endless loop on its side. Between the bands *5a* and *5b* runs a web 7, which is against the band *5a* that is next to the vapour chamber 3, and a felt or wire 8, which is against the band *5b* that is next to the water chamber 1. Those sides of the bands *5a* and *5b* that are against the chambers 1 and 3 respectively are open so that the liquid and vapour may directly affect the bands, and each band *5a* and *5b* provides one wall for one chamber. Due to this, the band *5a* next to the vapour chamber 3 becomes hotter and thereby heats the fibre web 7 located against it. The water in the fibre web 7 vaporizes, transfers to the felt 8 and cools against the cold band *5b* that is next to the water chamber 1. The fibre web thus dries as it travels through the apparatus. The operation of the dryer is fully known per se, and it is therefore not described in greater detail herein.

FIG. 2 shows a schematic cross-sectional view of the chambers 1 and 3 in the arrangement according to the invention seen from the travel direction of the bands. The bands *5a* and *5b* are located such that they extend between the edges of the bodies *1a* and *3a* of the chambers 1 and 3. On that surface of the body *3a* of the chamber 3 that faces the band *5a* there are provided vapour seals 9 and 10, which are spaced from one another in the transverse direction of the band 5a. A vapour supplying conduit 32 may lead between the seals 9 and 10 to effect sealing between the seals and the band 5a. The sealing surfaces of the seals 9 and 10 are in contact with the surface of the band 5a and keep it spaced from the surface of the edge of the chamber 3 such that a vapour opening 11 is formed between the lower surface of the edge of the chamber 3 and the upper surface of the band 5a. Correspondingly, above the edge of the water chamber 1 are provided seals 12 and 13 whose sealing surfaces are in contact with the lower surface of the band 5b and keep it spaced from the upper surface of the edge of the chamber 1 such that a water opening 15 is formed between the band 5a and the surface of the chamber 1. The vapour opening 11 and the water opening 15 extend over the entire breadth of the edge to the other side of the seals 9, 10 and 12, 13 respectively and end at a recovery chamber 16, which is a closed space between the chambers 1 and 3 and from which one or more outlet conduits 17 lead out. The edges of the bodies of the chambers 1a and 3a are sealed with a seal 18. The edge of the felt or wire 8 is provided with a seal 8a consisting of filling paste, the seal sealing the space between the bands 5a and 5b and thus preventing water and vapour from entering.

The operation of the arrangement is based on the feature that due to the pressure, vapour on the one hand and water on the other hand tend to escape from between the seals 9, 10 and 12, 13 and the respective band 5a, 5b. Thereby they also lubricate the sliding surface between the seals and the band, which prolongs the life of the seals. The vapour discharges through the vapour opening 11 into the recovery chamber 16. To enhance lubrication of the lower band 5b next to the water chamber and the seals 12 and 13, water is supplied between them through a sealing water conduit 14, whereby the water pressure produces a moisture film between the seals and the band. The water discharging through the water opening 15 ends up in the recovery chamber 16 in the same manner as the vapour, and the water and vapour are then discharged together through the outlet conduit 17. By controlling the flow in the outlet conduit 17, i.e. by adjusting the size of the port in the conduit, the pressure in the recovery chamber 16 can be rendered higher than the atmospheric pressure and yet during of discharge of water and vapour it is always lower than the vapour and water pressure in the vapour chamber 3 or the water chamber 1. However, the pressure difference can be maintained such that the vapour and water lubricate the sliding surface between the seals and the bands but that the seals are not exposed to high pressure— and thereby extra stress—as in the earlier solutions. By the present arrangement, the use, operating conditions and loading of the seals can be adjusted such that they are as optimal as possible in respect of the use. Another advantage is that as the vapour discharges from between the seals, it does not cause noise problems or other problems since it does not discharge into air but gathers in the recovery chamber 16 from where it is conducted for further use. As the vapour and water discharge through their respective openings, the water keeps the band that is next to the water chamber 1 at an essentially even temperature over its entire breadth, and the vapour keeps the band that is next to the vapour chamber 3 hot and at an essentially even temperature over its entire breadth, whereby shrinkage or elongation does not occur between the edges and the other parts of the band in the longitudinal direction due to essential lack of differences in temperature. This in turn improves the usefulness of the apparatus and prolongs the life of the bands.

FIG. 3 shows schematically how the idea of the invention can be applied in the seals at the ends of the chambers 1 and 3, where the bands come into sight from between the chambers. Since the bands come into sight, vapour and water are gathered in separate recovery chambers in this solution, and they are then discharged separately. In this embodiment, three successive seals 19, 20 and 21 are provided at the edge of the chamber 1 that is next to the band 5b, the seals being spaced from one another, and recovery chambers 22 and 23 are provided between adjacent seals. In the recovery chamber 22 there gathers water, which flows through the water opening 15 from between the seal 19 and the band 5b and is then discharged therefrom through an outlet conduit 24. The flow in the outlet conduit 24 is regulated such that pressure remains in the recovery chamber 22. From the recovery chamber 22 water is further transferred through the water opening 15 from between the seal 20 and the band 5b to the second recovery chamber 23, from which the water is discharged through a conduit 25. Restriction of water discharge is not necessarily needed in this chamber but the water can be removed from the chamber essentially without pressure. Further, the contact between the seal 21 and the band 5b is very light and the seal mainly prevents formation of splash water as the band 5b moves away from the chamber. Correspondingly, on the side of the vapour chamber 3 there are seals 26 and 27 and a vapour recovery chamber 28 between them. Vapour and condensate escape from between the seal 26 and the upper band 5a to the vapour recovery chamber 28 and discharge through a conduit 29. Some of the vapour further discharges from between the seal 27 and the band 5a into an absorbing chamber 30, from which the vapour can be gathered. The vapour can be prevented from escaping by using a seal 31 that is in light contact with the band. In this manner, vapour can also be prevented from escaping into air at the ends of the dryer, whereby the noise problems as well as other problems caused by vapour are avoided.

The invention is described above in the specification and in the drawings only by way of example, and the invention is not limited thereto in any way. Any kinds of seals that are suitable for sealing a sliding surface can be employed. The seal can be a separate seal or if desired it can be provided at the edge of the chamber by shaping it as a sealing surface. The seals can also be either embedded in the structures of the chamber or in separate easily replaceable cassettes. The number of successive seals may be varied to achieve suitable tightness and suitable life for the seals. The arrangement according to the invention can also be applied such that the seals 9 and 10, which in the FIGS. are between the upper chamber and the upper band, are left out, whereby the pressure in the side chambers 16 is equal to that in the vapour chamber 4. Also, seals 9 and 10 can be replaced by one uniform seal having a groove in the middle and a conduit leading thereto for supplying of sealing vapour. Further, the lower seals 12 and 13 can be replaced by one uniform seal having a groove in the middle and a conduit leading thereto for supplying of lubricating water.

We claim:

1. An arrangement in a dryer for a fibre web, the arrangement comprising:

two bodies (1a, 3a) for defining lower and upper chambers (1, 3) respectively for containing a pressurized medium that is a vapour in the upper chamber (3);

two impermeable bands (5a, 5b) travelling next to edges of the chambers (1, 3) and forming an endless loop, each band providing one wall for a respective one of the chambers (1, 3), a fibre web (7) and wire (8) travelling between the bands (5a, 5b);

at least one sealing member (12, 13) between the edge of the body (1*a*) of the lower chamber (1) and the band (5*b*) next to it for sealing between the moving band (5*b*) and the body (1*a*) of the lower chamber (1); and on at least one of sides of the chambers (1, 3), recovery chambers (16) into which edges of the bands (5*a*, 5*b*) extend and which are isolated from the surrounding air and the chambers (1, 3) for pressurized medium that is discharged from both of the chambers (1, 3) from between the bodies (1*a*, 3*a*) and the bands (5*a*, 5*b*) to gather in and be dischargeable therefrom through outlet conduits (17).

2. The arrangement according to claim 1, characterised in that discharging of the pressurized medium from the recovery chambers (16) is restricted such that a pressure that is lower than the pressure in the chambers (1, 3) that contain pressurized medium but higher than the atmospheric pressure is produced in the recovery chamber (16).

3. The arrangement according to claim 1, wherein the pressurized medium in the lower chamber (1) is water, characterised in that between the body (1*a*) of the lower chamber (1) and the lower band (5*b*) there are two or more sealing surfaces that face the band (5*b*) and are spaced from one another, and that the sealing means comprise a conduit (14) for supplying water between said sealing surfaces.

4. The arrangement according to claim 3, characterised in that the sealing surfaces are provided at the edges of the body (1*a*) of the lower chamber.

5. The arrangement according to claim 3, characterised in that the sealing surfaces are sealing surfaces of separate seals (12, 13) arranged in the body (1*a*) of the lower chamber (1).

6. The arrangement according to claim 2, wherein the pressurized medium in the upper chamber (3) is vapour, characterised in that between the body (3*a*) of the upper chamber (3) and the upper band (5*a*) there are two or more sealing surfaces that face the band (5*a*) and are spaced from one another, and that the sealing means comprise a conduit (3*a*) for supplying vapour between said sealing surfaces.

7. The arrangement according to claim 6, characterised in that the sealing surfaces are provided at the edges of the body (3*a*) of the upper chamber.

8. The arrangement according to claim 6, characterised in that the sealing surfaces are sealing surfaces of separate seals (9, 10) arranged in the body (3*a*) of the upper chamber (3).

9. The arrangement according to claim 1, characterised in that the recovery chamber (16) is essentially divided into two portions that are one upon another, water being discharged through the lower portion and vapour through the upper portion.

10. The arrangement according to claim 2, wherein the pressurized medium in the lower chamber (1) is water, characterized in that between the body (1*a*) of the lower chamber (1) and lower band (5*b*) there are two or more sealing surfaces that face the band (5*b*) and are spaced from one another, and that the sealing means comprise a conduit (14) for supplying water between said sealing surfaces.

* * * * *